US009289636B2

(12) United States Patent
Mathis

(10) Patent No.: US 9,289,636 B2
(45) Date of Patent: Mar. 22, 2016

(54) FIRE EXTINGUISHING AGENT AND METHOD OF USE

(76) Inventor: James A. Mathis, Fort Worth, TX (US)

( * ) Notice: Subject to any disclaimer, the term of this patent is extended or adjusted under 35 U.S.C. 154(b) by 1527 days.

(21) Appl. No.: 12/927,505

(22) Filed: Nov. 17, 2010

(65) Prior Publication Data

US 2012/0118590 A1 May 17, 2012

(51) Int. Cl.

| | |
|---|---|
| ***A62D 1/02*** | (2006.01) |
| ***A62D 1/00*** | (2006.01) |
| ***A62C 3/00*** | (2006.01) |

(52) U.S. Cl.

CPC ..... *A62D 1/0071* (2013.01); *A62D 1/0007* (2013.01); *A62D 1/0014* (2013.01); *A62D 1/0064* (2013.01)

(58) Field of Classification Search

USPC ..... 169/46, 47

See application file for complete search history.

(56) References Cited

U.S. PATENT DOCUMENTS

| | | | | |
|---|---|---|---|---|
| 3,941,722 | A * | 3/1976 | Shevlin | 510/130 |
| 3,976,580 | A | 8/1976 | Kaminstein et al. | |
| 4,151,105 | A * | 4/1979 | O'Roark | 510/151 |
| 4,552,803 | A * | 11/1985 | Pearson | 442/142 |
| 4,560,485 | A * | 12/1985 | Szekely et al. | 252/7 |
| 4,606,831 | A * | 8/1986 | Kegeler et al. | 252/7 |
| 4,792,443 | A * | 12/1988 | Filomeno | 424/62 |
| 5,053,146 | A | 10/1991 | Yamaguchi | |
| 5,104,735 | A * | 4/1992 | Cioffi et al. | 428/383 |
| 5,518,638 | A | 5/1996 | Buil et al. | |
| 5,882,541 | A * | 3/1999 | Achtmann | 252/8.05 |
| 6,395,200 | B2 * | 5/2002 | Crouch et al. | 252/603 |
| 6,780,991 | B2 | 8/2004 | Vandersall et al. | |
| 6,930,138 | B2 * | 8/2005 | Schell et al. | 524/145 |
| 6,989,113 | B1 | 1/2006 | Mabey | |
| 8,273,813 | B2 * | 9/2012 | Beck et al. | 524/321 |
| 2003/0047723 | A1 * | 3/2003 | Santoro | 252/601 |
| 2004/0052826 | A1 * | 3/2004 | Fernandez-Kleinlein et al. | 424/401 |
| 2004/0099178 | A1 * | 5/2004 | Jones et al. | 106/18.21 |
| 2005/0048090 | A1 * | 3/2005 | Rau | 424/401 |
| 2005/0279972 | A1 * | 12/2005 | Santoro et al. | 252/603 |
| 2006/0127430 | A1 * | 6/2006 | Gupta | 424/401 |
| 2007/0054830 | A1 * | 3/2007 | Dullea et al. | 510/365 |
| 2010/0062153 | A1 * | 3/2010 | Curzon et al. | 427/203 |
| 2011/0073794 | A1 * | 3/2011 | Hagquist et al. | 252/2 |
| 2011/0089073 | A1 * | 4/2011 | Baig et al. | 206/524.1 |

* cited by examiner

*Primary Examiner* — Joseph D Anthony

(57) ABSTRACT

A fire-extinguishing composition has a water-thickening agent and a foaming agent. The fire-extinguishing composition contains less than 10 vol % water. The ratio of water-thickening agent to foaming agent is from 99:1 to 1:99 volume ratio. The composition is in the form of a powder or flake. A method of extinguishing a fire is by applying a mixture of a fire-extinguishing composition and water to a fire, the fire-extinguishing composition having a water-thickening agent and a foaming agent.

10 Claims, No Drawings

FIRE EXTINGUISHING AGENT AND METHOD OF USE

BACKGROUND

1) Field of Disclosure

This disclosure relates to the field of extinguishing or retarding fires. The present disclosure has particular applicability to a powder type fire extinguishing agent and methods of use of the fire extinguishing agent.

2) Description of Related Art

In general, foam type fire extinguishing agents have been used to extinguish fires of flammable liquids. These include hydrophilic combustible liquids such as alcohols, ketones, ethers, and the like. In addition, fire extinguishing agents can be used for combating combustion of certain other materials such as gasoline and other fuel sources. The disadvantage of most fire extinguishers for such liquid fuel fires is that the fire antagonist is required in large volume for the purpose of extinguishing a fire. This is because the fire extinguishing agent must limit the access of oxygen to the fuel source, such as by a foam barrier. Alternatively, the fire extinguishing agent must act to cool the material below the flash or combustion point.

Many different fire extinguishing compositions and fire extinguishing systems using such compositions have been developed and are available on the market. However, re-flash or auto-ignition of the hot shortening, oils or greases in Class B fires remains a serious problem. This is true, particularly, when such fires involve large commercial establishments, such as restaurants, cafeterias, mess halls, etc. The potential danger of such fires in these types of establishments is widely recognized.

Another disadvantage of certain fire extinguishing agents is that they are comprised of or contain highly toxic materials. Many fires such as flammable fuel fires and the like should be contained very rapidly to avoid water-fuel mixture run-off from the fire site.

U.S. Pat. No. 6,989,113 teaches a starch plus ammonium phosphate in liquid form. U.S. Pat. No. 3,976,580 teaches an aqueous polyacrylamide and bentonite formulation. However, these fire extinguishing materials are in liquid form, and may suffer the related problems mentioned above.

U.S. Pat. No. 5,518,638 discloses a 1-9% aqueous suspension of silica and PEG, PPG of MW 700-600,000. Another patent (U.S. Pat. No. 5,053,146) teaches a dry powder having 70-95% $B_2O_3$ and 5-30% silica. However, these patents contain no foaming agents, and are therefore not particularly applicable to class B fires.

Some compositions utilize xanthan gum. For example, U.S. Pat. No. 6,780,991 uses ammonium phosphate, xanthan gum and surfactants, of which foaming agents would be considered. However, ammonium phosphate is rather toxic, especially when burned and accordingly, may cause unwanted environmental harm when used for fire extinguishing purposes.

SUMMARY

In order to overcome these problems, the present disclosure is directed to a fire extinguishing compound, a method for making a fire extinguishing compound and a method for extinguishing a fire using a fire extinguishing compound.

In one embodiment, the fire-extinguishing composition comprises a water-thickening agent, and a foaming agent, wherein the fire-extinguishing composition contains less than 10 vol % water. Optionally, the composition contains less than 1 vol % water. In certain embodiments, the ratio of water-thickening agent to foaming agent is from 99:1 to 1:99 volume ratio. In another embodiment, the composition is in the form of a powder or flake.

The present disclosure is also directed toward a method of manufacturing a fire-extinguishing composition comprising the step of mixing a water-thickening agent with a foaming agent. The water-thickening agent is combined with the foaming agent in a volume ratio from 99:1 to 1:99. In some embodiments, the amount of water in the fire-extinguishing composition is less than 10 vol %. Optionally, the composition contains less than 1 vol % water.

The present disclosure is also directed toward a method of extinguishing a fire, comprising the step of applying a fire-extinguishing compound to a fire, with the fire-extinguishing compound being comprised of a water-thickening agent, and a foaming agent. In some embodiments the fire-extinguishing composition may contain less than 10 vol % water. Optionally, the composition contains less than 1 vol % water.

The fire extinguishing compound is blended with water and then sprayed as a foam onto solid or liquid surfaces, thereby the resultant foam extinguishes or retards fire. The foam is also very durable, thereby reducing the risk of re-ignition of fire.

Additional advantages and other features of the present disclosure will be set forth in part in the description which follows and in part will become apparent to those having ordinary skill in the art upon examination of the following or may be learned from the practice of the disclosure. The advantages of the disclosure may be realized and obtained as particularly pointed out in the appended claims.

As will be realized, the present disclosure is capable of other and different embodiments, and its several details are capable of modifications in various obvious respects, all without departing from the disclosure. Accordingly, the description is to be regarded as illustrative in nature, and not as restrictive.

DETAILED DESCRIPTION

Illustrative embodiments are now discussed. Other embodiments may be used in addition to or instead of the provided examples. Details that may be apparent or unnecessary may be omitted to save space or for a more effective presentation. Conversely, some embodiments may be practiced without all of the details that are disclosed.

In one embodiment of the present disclosure, the fire-extinguishing composition comprises a water-thickening agent, and a foaming agent. In some embodiments, the water-thickening agent utilized in the present disclosure is at least one selected from the group consisting of polysaccharides, polyacrylamides, and fumed silicas.

Polysaccharides as described in the present disclosure are polymeric carbohydrate structures formed of repeating units (either mono- or di-saccharides) joined together by glycosidic bonds. Examples of polysaccharides include starches, celluloses, and glycogen.

Certain exemplary polysaccharides include a konjac gum/xanthan gum mixture. Konjac gum is a non-ionic type polysaccharide, and therefore influenced only slightly by the presence of salt in the system. At ambient temperature, konjac gum remains stable without precipitation even if the pH drops to a level below 3.3. Xanthan gum does not gelatinize when used alone, but it can form gel at any pH when used in combination with konjac gum. At a pH of 5, the two gums show a greatest synergistic effect and when xanthan gum is used with konjac gum at a ratio of 3:2, the greatest gelatification will be achieved.

In other embodiments of fire-extinguishing compositions of the present disclosure, the foaming agent is an ester or a sodium salt thereof. Esters are compounds containing a carbon oxygen double bond in which the carbon atom is covalently bonded to the oxygen of an alkoxy group. The ester used may be any ester suitable for use in a fire extinguishing formulation. In some embodiments, the ester or sodium salt of the ester includes sodium lauryl sulfoacetate.

In certain embodiments, the ratio of water-thickening agent to foaming agent is from 99:1 to 1:99 by volume. Optionally, the ratio of water-thickening agent to foaming agent is from 50:50 to 1:99 by volume. Dispersants may also be used in the formulation to minimize clumping when the thickening agent/foaming agent blend is mixed with water prior to use on a fire. In addition, the dispersing agent may aid in the mixing of the thickening agent and the foaming agent. Optionally, the formulation contains no dispersant, as the foaming agent may provide dispersing action for the water thickening agent (foam stabilizer) suitable for use in fire-extinguishing formulations. In other embodiments, up to 100% in the formulation is comprised of a thickening/gelling agent. A formulation containing high ratios of thickening/gelling agent is useful for fighting class A fires.

In some applications, it is sometimes desirable to have formulations with a low water content. This allows for a greater firefighting capacity per unit volume and therefore, greater economy of storage. In addition, since the mixture has low moisture content, anti-freeze ingredients are not required, thereby reducing the negative environmental impact of the mixture. In some embodiments, the amount of water contained in the fire-extinguishing formulation is less than 10% by volume. In other embodiments, the amount of water in the formulation is less than 5% by volume. In yet other embodiments, the water content is less than 1% by volume.

In certain embodiments, a dry fire extinguishing formulation is mixed with water before application of the aqueous fire extinguishing solution to a fire. For example, the fire extinguishing formulation could be mixed in a water tank of a fire truck, or other container suitable for mixing the solution. In one example, water is added to the formulation to form a solution comprising 1 to 20 parts by volume of fire extinguishing formulation per 100 parts by volume water. Optionally, the formulation can be from 1 to 6 parts by volume of fire extinguishing formulation per 100 parts by volume of water.

In certain embodiments, the fire-extinguishing compositions have lowered environmental impact. In these embodiments, the foaming agents and thickening/gelling agents have low toxicity as well as good foaming characteristics when fighting fires using either fresh or salt water. In one embodiment, the foaming agent is sodium lauryl sulfoacetate. However, other foaming agents with low toxicity may be used either separately or in combination with sodium lauryl sulfoacetate.

The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the disclosure. However, it should be recognized that the present disclosure can be practiced without resorting to the details specifically set forth. In other instances, well known processing structures have not been described in detail, in order not to unnecessarily obscure the present disclosure.

Only a few examples of the present disclosure are shown and described herein. It is to be understood that the disclosure is capable of use in various other combinations and environments and is capable of changes or modifications within the scope of the inventive concepts as expressed herein.

EXAMPLES

Two different measurements are highly correlated as far as determining the effectiveness of exemplary fire extinguishing compositions. The first measurement is the time that it takes for a water phase to begin forming beneath a quantity of foam that has been placed at the bottom of a container. A result is considered more positive or favorable as the time required for phase separation increases.

The second measurement, called a torch test, is to measure (30 grams by weight) an amount of foam and place it on top of a small amount of gasoline in a crucible. Then the time for a hand-held torch to burn through the foam and start the gasoline to burning is measured. The torch is held at a distance of 2 inches from the foam surface and at a 45 degree angle to it. The comparison is made against commercially available aqueous film forming foam (AFFF) products such as Ansul (Ansulite®), Fomtec 3% AFFF, and Chemguard® 3%, in other fire-extinguishing formulations. Generally, the commercially available products work by having a thin foam/film spread over the surface of the burning liquid, preventing the vapor from rising, and thereby extinguishing the fire.

Example 1

1 cc Coyote Brand Stabilizer KX-BS (Konjac Gum/Xanthan Gum proprietary blend obtained from Gum Technology™) is mixed with 1 cc sodium lauryl sulfoacetate (Lathanol LAL Powder™: 65-72% SLSA, 5-18% sodium sulfate, and 10-18% sodium chloride. Ingredients To Die For™) to form a dry powder mixture.

Added to the mixture is 2 cc Aerosil 200 (hydrophilic fumed silica obtained from Evonik Degussa™), as a dispersing agent for the gum blend to minimize clumping, and which also provides minimal water thickening in its own right. The dry powder mixture was added to water to make a 3% aqueous solution, which was then blended into a foam. 30 grams of the resultant foam was then placed in a crucible on top of about 10 grams of gasoline. A torch test was then conducted as previously described. It took 4.5 minutes for the torch to burn a hole through the foam and ignite the gasoline.

The longest time measurement for the commercially available products listed above using the torch test was 18 seconds. The foams that the exemplary formulations of the present disclosure make spread across the surface of a burning liquid, and form a denser layer than the commercially available formulations.

The invention claimed is:

1. A fire-extinguishing composition comprising:

a water-thickening agent; and a foaming agent, wherein the fire-extinguishing composition contains less than 10 vol % water, wherein the foaming agent is sodium lauryl sulfoacetate, and wherein the amount of water-thickening agent, sodium lauryl sulfoacetate, and water is 100% by volume of the fire-extinguishing composition.

2. The fire-extinguishing composition of claim 1, wherein the composition is a powder or flake.

3. The fire-extinguishing composition of claim 1, wherein said water-thickening agent is at least one selected from the group consisting of polysaccharides, polyacrylamides, and fumed silicas.

4. The fire-extinguishing composition of claim 3, wherein said water-thickening agent is a polysaccharide.

5. A fire-extinguishing composition comprising:

a water-thickening agent; and a foaming agent, wherein the fire-extinguishing composition contains less than 10 vol % water, and wherein said water-thickening agent is a konjac gum/xanthan gum mixture.

6. The fire-extinguishing composition of claim 1, wherein the water-thickening agent and foaming agent have a ratio of from 99:1 to 1:99 by volume.

7. The fire-extinguishing composition of claim 1, wherein the fire-extinguishing composition contains less than 1 vol % water.

8. A fire-extinguishing composition comprising:

a konjac gum/xanthan gum mixture; and sodium lauryl sulfoacetate, wherein the konjac gum/xanthan gum mixture and sodium lauryl sulfoacetate have a ratio of from 99:1 to 1:99 by volume.

9. The fire-extinguishing composition of claim 1, wherein the ratio of water-thickening agent to foaming agent is 1:1 by volume.

10. The fire-extinguishing composition of claim 1, wherein at least one of the water-thickening agent and the foaming agent contains a cation or anion.

* * * * *